US005289655A

United States Patent [19]

Marmora et al.

[11] Patent Number: 5,289,655

[45] Date of Patent: Mar. 1, 1994

[54] SAFETY RELEASE SECURITY GRILLE

[76] Inventors: Fausto Marmora; Daniele A. Marmora, both of 1-10 Glebe Street, Glebe 2037 (NSW), Australia

[21] Appl. No.: 910,040

[22] PCT Filed: Feb. 8, 1991

[86] PCT No.: PCT/AU91/00044

§ 371 Date: Oct. 8, 1992

§ 102(e) Date: Oct. 8, 1992

[87] PCT Pub. No.: WO91/12403

PCT Pub. Date: Aug. 22, 1991

[30] Foreign Application Priority Data

Feb. 8, 1990 [AU] Australia ..... PJ 8527

[51] Int. Cl.[5] ..... E05B 65/10

[52] U.S. Cl. ..... 49/141; 49/56; 49/395

[58] Field of Search ..... 49/141, 56, 50, 395

[56] References Cited

U.S. PATENT DOCUMENTS 4,249,345 2/1981 Littleton ..... 49/141 X
4,304,070 12/1981 Musacchia ..... 49/141 X
4,630,396 12/1986 Zvi et al. ..... 49/56 X
4,634,157 1/1987 Fernandez ..... 49/141 X
4,671,015 6/1987 Curry et al. ..... 49/395 X
4,677,789 7/1987 Merry ..... 49/56
4,937,975 7/1990 Zilkha ..... 49/56

*Primary Examiner*—Philip C. Kannan
*Attorney, Agent, or Firm*—David H. Jaffer

[57] ABSTRACT

A security grille (1) adapted to securely close off a window, but which may be manually released from within the building including the window while maintaining security preventing unauthorized access from the exterior of the building. The grille (1) is attached along one edge by hinges (2), or by a releasable mechanism, and is lockable in position by locking device (20) on an opposite edge. The locking device (20) may including locking bolts which protrude out through holes (21, 24 ) which engage holes (22, 25) within a surrounding frame (32). The grille (1) can comprise two portions (1*a*, 1*b*) joined at their mating edges by further hinges (23). The frame (32) is secured by bolt devices (26), or the like to the wall structure of the building surrounding the window to be protected.

9 Claims, 4 Drawing Sheets

SAFETY RELEASE SECURITY GRILLE

BACKGROUND ART

This invention relates to security grilles for windows that can be released in order to effect an emergency exit from the building which they secure.

In emergency situations, such as fire, the occupants of a building will often not be able to reach normal exits, or because of panic they might not firstly obtain the necessary keys to release, e.g. deadlocked, security doors. Therefore security grilles which are releasable without the requirement of a key are desirable in at least many establishments.

Australian patent specification 79341/87 discloses such a releasable security grille but it has been found that there is a viable alternative to the actual release/-locking mechanism disclosed in that specification.

DISCLOSURE OF INVENTION

Accordingly, the present invention may be said to consist in a window security grille including:

first attachment means at a first edge of the grill, being securable to an exterior or interior wall proximate a window opening or within the window opening of a building and allowing release or pivotable movement of the grille relative to such wall;

anchor means rigidly attachable to the wall proximate the window opening or within the window opening to be opposite the first attachment means;

second attachment means, at a second edge of the grille opposite the first edge, including a locking portion and an actuating device both being secured to the grille and the actuating device both moving the locking portion between locked and released positions, the locking portion lockingly engaging the anchor means when in the locked position when the grille is closed to secure the grille closed and releasing same when in the released position.

Preferably in one embodiment the actuating device receives when the grille is closed a release control device being connected to the wall and including a handle end and an opposite actuating end inserted through such wall, the actuating end engaging the actuating device so that manual operation of the handle end effects said moving the locking portion.

Preferably in an alternative embodiment the actuating device includes a manually operable lever integral with a frame of the grille.

Preferably the first attachment means a-re formed by at least two hinging devices having a common hinging axis and each being rigidly attached along the first edge of the grille and rigidly attachable to such exterior wall in a method that prevents its release from the wall at least while the grille is in a closed secure position relative to the wall.

Preferably the anchor means are a pair of eye structures rigidly joined to a plate adapted to be attached to the wall exterior preferably by counter sunk screw means. In one form the anchor means are eyebolts or similar devices with their eye sections exposed on the exterior wall or interior wall, as required, and their shank portions extending through the wall and securely fastened to the wall. Upon closing the grille into the closed secure position proximate the exterior or interior wall, entrant portions within the second edge of the grille accept the eye portions and the locking portions, being proximate the cut-outs, are sliding bolts which, in the locked position are slid into and through the eye portions.

Preferably the locking portions are sliding bolt devices actuated by pivotal lever devices connected by respective reciprocating rods to a further pivotal lever device rotated by the actuating device.

Preferably the actuating device includes a non-circular hole which receives in a torque transmitting co-operative manner, the actuating end which is of a similar cross-sectional shape and size to the hole.

BRIEF DESCRIPTION OF DRAWINGS

By way of example only, one preferred form of the present invention will now be described with reference to the accompanying drawings in which.

BEST MODE OF CARRYING OUT INVENTION

Figure 1:
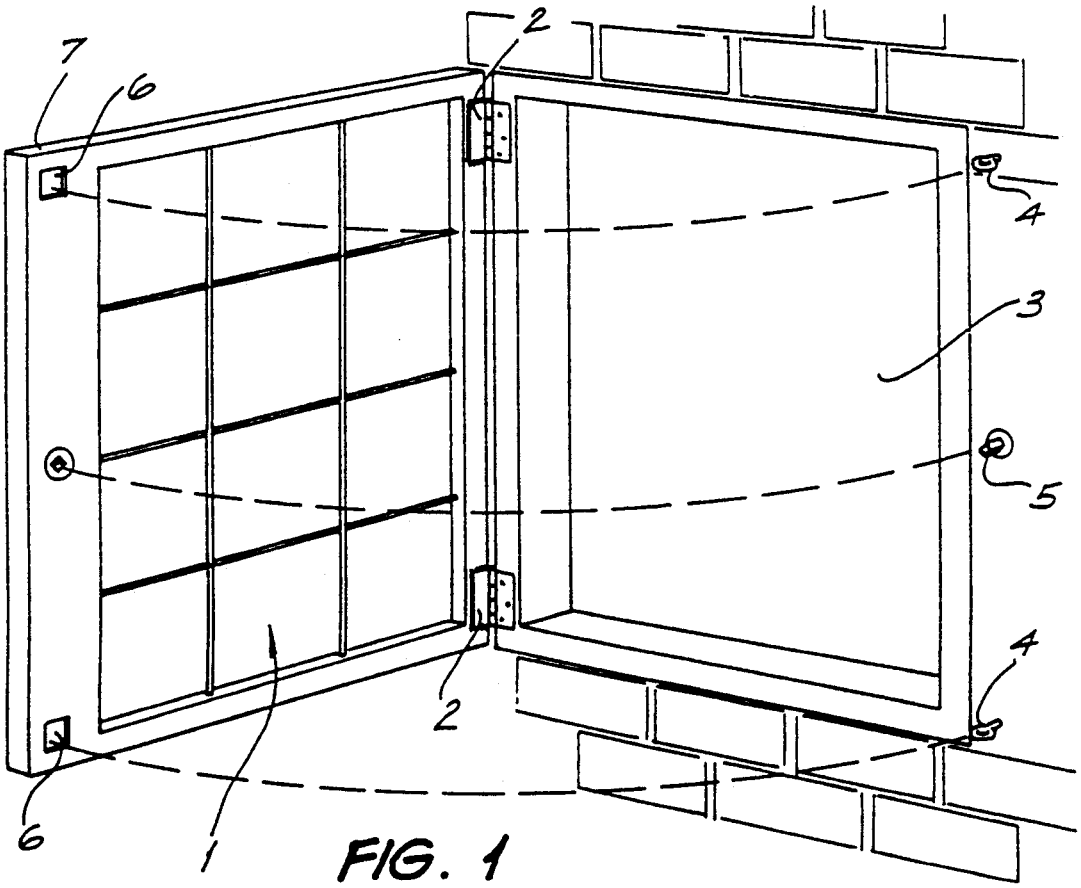
FIG. 1 is a perspective view of an installed security grille in a partially opened position according to the invention.

FIG. 1 shows the grille 1 attached to a building external or interior wall by a pair of hinges 2. The perimeter section of the grille 1 is conveniently steel or other material and the pair of hinges 2 are conveniently welded to that perimeter and bolted by Dynabolts, or other suitable attachments, to the wall so that when the grille is in the secure, closed position the securing bolts are covered by the grille itself.

On the side of the window opening 3 that is opposite to the pair of hinges 2 are located a pair of eyebolts 4 and a protruding, square cross-sectioned shaft 5.

The perimeter edge of the grille 1 that is opposite to the pair of hinges 2 includes at each extreme end, that is its top and bottom, a respective lock opening or "cut-out" 6. At least this grille perimeter member is hollow and the respective extreme ends 7 are blanked off in some convenient secure manner, e.g. by welding a plate across the otherwise open end.

Figure 2:
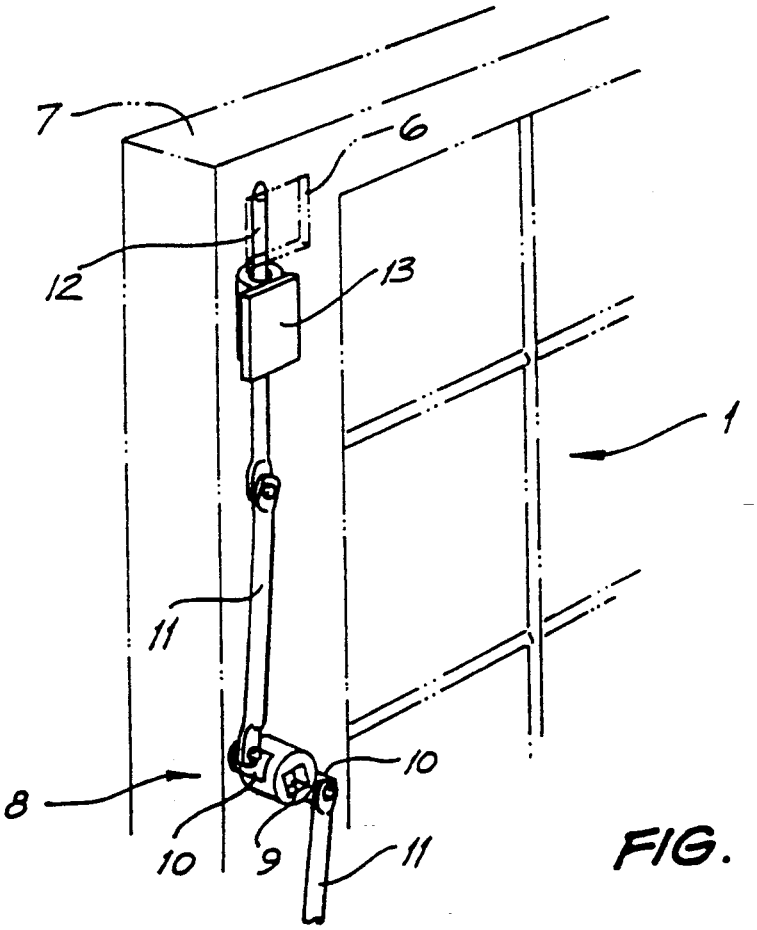
FIG. 2 shows a perspective partially exposed view of a section of the device shown in FIG. 1.

A middle section of this perimeter member of grille 1 also includes a lock actuator device 8, the detail of which is more clearly shown in FIG. 2.

The actuator 8 includes a square cross-sectioned blind hole 9 which is of a similar sized cross-section to that of shaft 5. This hole 9 is within a shaft which carries a pair of actuator arms 10, themselves linked by respective pivots to arm links 11.

Each arm link 11 is attached to a locking bolt 12 which can slide in its carrier 13. Turning the lock actuator 8 results in the locking bolts 12 reciprocating between a locked position in which the bolt 12 slides completely across its opening 6, and an unlocked position in which the bolt 12 is withdrawn leaving the lock opening 6 clear.

The bolt carrier 13 can be any convenient sleeve type construction rigid with the perimeter frame proximate the opening 6, for example, a simple steel tube spot welded in place internally of the perimeter frame.

The shaft 5 is secured to the wall but able to rotate and extends through the wall to a handle (not shown) on the interior surface. At installation of the grille, the shaft 5 is aligned with the lock actuator 8 so that as the grille is closed the square end of shaft 5 enters into and engages the blind hole 9. Thus, upon turning the handle, the lock actuator 8 is manipulated and the locking bolts 12 moved between the locked and unlocked positions.

Also, the eyebolts 4, at installation, are aligned with their respective openings 6 so that when grille 1 is closed the eyebolt eyes reside within the opening 6 and are aligned with their locking bolt 12. Thus, when the grille is closed and the lock placed in the locked position, each locking bolt 12 moves into and through its respective eye so as to secure the grille closed.

The eyebolts 4 conveniently include Dynabolt fasteners or alternatives suitable for the particular wall.

When grille 1 is closed the various attachments, that is the pair of hinges 2, the eyebolts 4, the lock actuator 8 and the shaft 5, are all fully covered and made tamper proof by the grille 1 itself.

Figure 3:
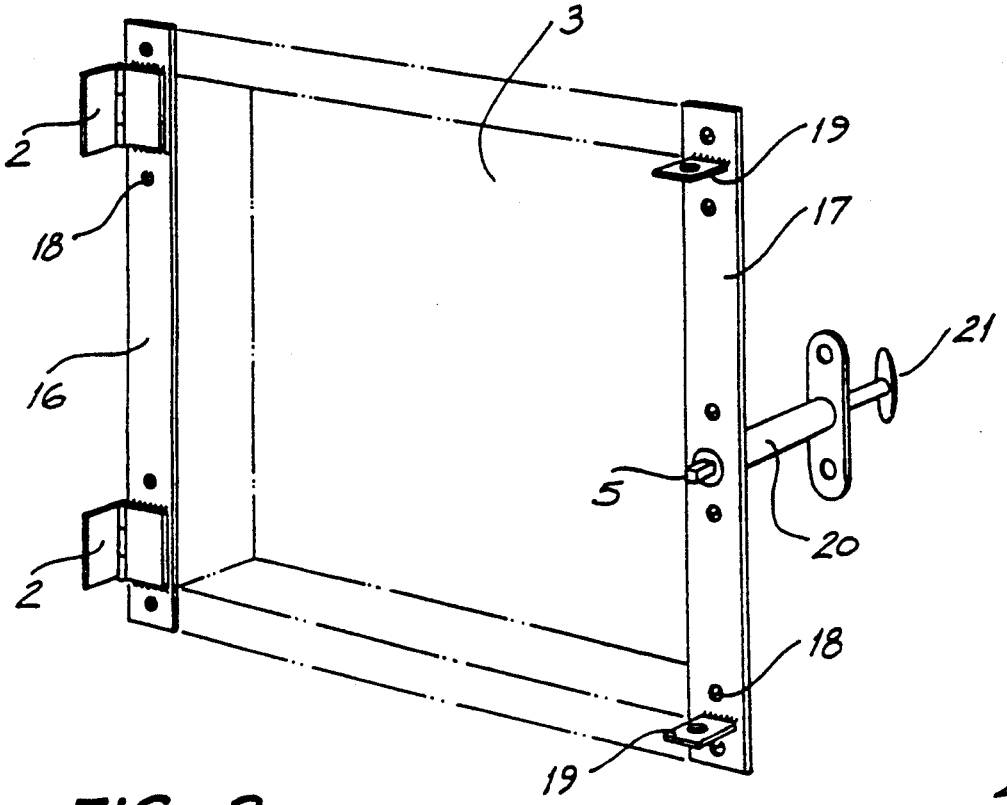
FIG. 3 shows an alternative design feature.

FIG. 3 shows optional structure being a pair of plates 16 and 17 which are screwed by counter sunk fasteners 18 to the external wall. The plate 16 carries the pair of hinges 2 welded to it and welded to the grille frame (not shown). The plate 17 carries a pair of welded eye devices 19 which will align with the cut-outs 6 and locking bolts 12 of the grille. A torque shaft 20 includes the square shaft 5 and sits snugly between the plate 17 and a handle 21 attached to the opposite interior wall.

On the wall interior, any exposed hardware such as bolts attaching the hinges 2 or eyebolts 4, can be conveniently covered by decorative covers.

Many design features such as the shape and pattern of the grille 1, the structure and number of hinges 2, and the locking portions exemplified by the locking bolt 12 and the actuator 8, are all subject to modifications and variations at the choice of the person skilled in the art.

Figure 4:
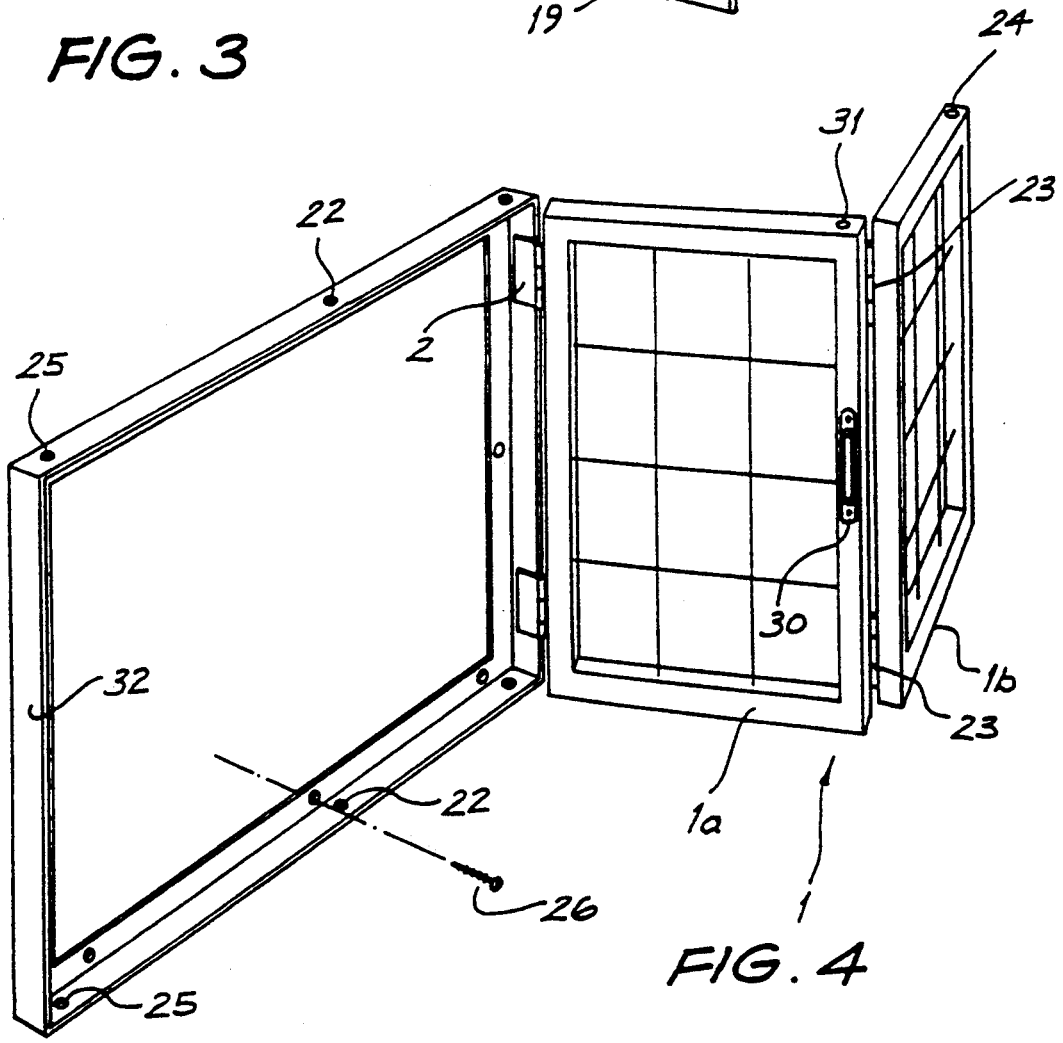
FIG. 4 shows a further embodiment of the invention in a perspective view.

The security grille 1 shown in FIG. 4 is particularly well adapted for wide window openings and comprises two hinged together grille sections 1*a* and 1*b*. Grille section 1*a* is hinged to a generally rectangular frame 32. The hinges 2 are conveniently welded to both the frame 32 and grille section 1*a*. The opposite edge of the grille section 1*a* can be locked in the closed position relative to the frame 32 by way of a proprietary flush mounted lever lock actuator 30 recessed into the hollow frame perimeter of the grill. The lever lock actuator 30 actuates a pair of locking bolts which run up and down the perimeter frame of the grille section 1*a* so as to protrude out the top and bottom ends at 31. The locking bolts, when protruding in the locked position, enter and engage the cooperative locking holes 22 of the frame 32.

The second grille section 1*b* is attached by hinges 23 to the section 1*a*. The attachment is such that the section 1*b* may be pivotally opened relative to the frame 19 while the section 1*a* is still locked in the closed position. Grille section 1*b* has a similar locking mechanism to the lever lock actuator 30 of section 1*a*, the locking bolts protruding out through end holes at 24 to engage holes 25 of frame 32.

The frame 32 is fabricated from welded together angle sectioned lengths of metal. The frame 32 is rigidly attached to an outside building wall about a window opening 3 by a plurality of suitable screws or bolts 26 (only one bolt 26 being shown). The bolts 26 are selected according to the material from which the wall is built, for example, Dynabolts TM for brick or concrete or wood screws for solid wood frames. The bolts 26 are counter-sunk and when the grille 1 is locked in the closed position the boltheads will be fully covered and out of reach from would be intruders.

Figure 5:
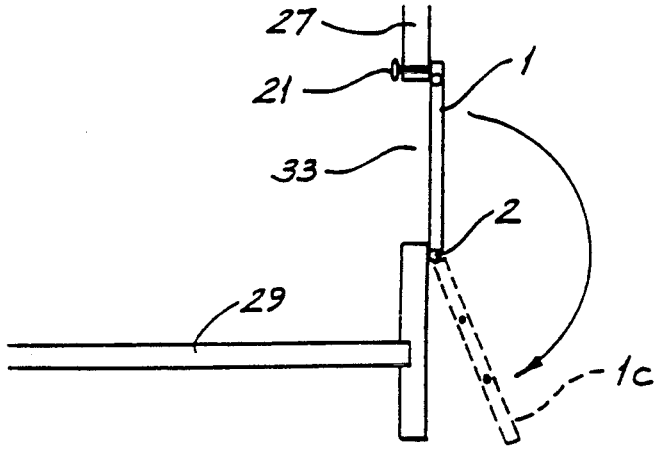
FIG. 5 shows a further embodiment of the invention installed in a building inside sectional elevation.
Figure 5:
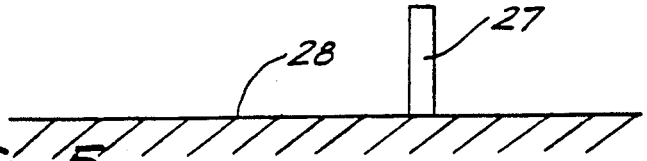

FIG. 5 schematically shows the cross section of a building wall having a ground floor 28 and first floor 29. A window opening 33 of the first floor 29 is protected by a security grille 1 which is pivoted by hinges 2 along its bottom horizontal edge. The hinges 2 include adjustably tensioned springs which biass the grille 1 into the closed position. The grille is locked in place, and unlocked, by a mechanism similar to that shown in FIG. 1 and includes the control handle 21. When the window grille 1 is unlocked by turning handle 21, people wishing to evacuate first floor 29 can push the grille fully open to position 1*c* and climb down the grille 1 in the manner of a ladder. This greatly reduces the height down which the escapees must fall unassisted, and also allows them to more easily fall to a point somewhat distant from the wall 27 at the base of the building.

Figure 6:
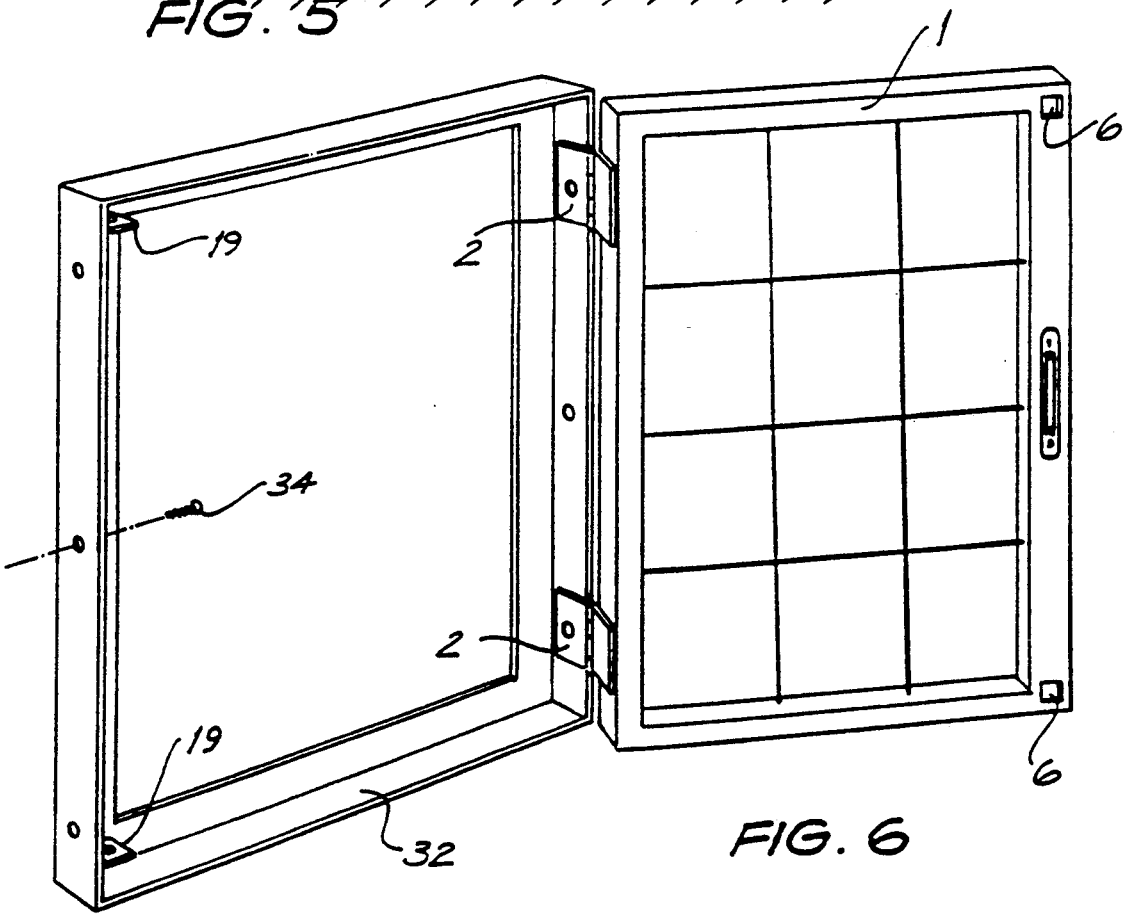
FIG. 6 shows a still further alternative embodiment of the invention in a view substantially similar to that of FIG. 4.

FIG. 6 shows what can be considered a modification of the security grille of FIG. 4. It shows a single grille 1 hinged by a pair of hinges 2 to a rectangular, angle sectioned, frame 32. However, in this case the frame 32 is adapted to be positioned closely within the cavity of a window 3 and to be attached by a plurality of outwardly extending bolts or screws 34 (only one of which is shown). Again, the bolts or screws 34 are selected according to the material from which the surrounding wall is produced. Thus in this case the frame 32 is held secure relative to the surrounding wall by the shear strength of the bolt screws 34 rather than, in the case of the FIG. 4 embodiment, the lesser of the tensile strength and the tensile holding power of the bolts 26.

Also the grille 1, of FIG. 6, is locked in position by a pair of eye devices or tongues 19 welded in place to the frame 32. Each tongue 19 extends in through respective openings 6 so as to be engageable by the locking bolts enclosed within the hollow perimeter frame of the grille 1 as described generally with respect to the locking device of FIGS. 1-3.

Thus the locking mechanism of the security grille is generally wholly within the hollow member of the perimeter frame of the grill that is opposite the hinged edge of the grill. The mechanism can optionally be a flush mounted mechanism such as mechanism 20, or can be actuated by a separate handle mechanism which is maintained protruding through the wall structure. This option allows not only an option as to the aesthetics but also allows the substantially same grille structure to be more easily adapted to a great variety of building design types.

We claim:

1. A window security grille including:

first attachment means at a first edge of the grille, being securable to an exterior wall proximate or within a window opening of a building and allowing release or pivotable movement of the grille relative to such wall;

anchor means rigidly attachable to the wall proximate the window opening to be opposite the first attachment means;

second attachment means, at a second edge of the grille opposite the first edge, including a locking portion and an actuating device both being secured to the grille and the actuating device moving the locking portion between locked and released positions, the locking portion lockingly engaging the anchor means when in the locked position when the grille is closed to secure the grille closed and releasing same when in the released position;

and a release control device connected to the wall and including a handle end and an opposite actuating end inserted through the wall and protruding from the wall to engage and rotatably drive the actuating device when the grille is closed against the window opening.

2. A window security grille as defined in claim 1 wherein the grille includes a perimeter frame being hollow at least along said second edge and the actuating device and locking portion being both within the hollow portion of the perimeter frame.

3. A window security grille as defined in claim 1 further comprising a rigid frame surround adapted to be permanently affixed to said external wall and having rigidly attached thereto said first attachment means and said anchor means.

4. A window security grille as defined in claim 3 wherein the anchor means are constituted by a pair of holes within the frame and being aligned with, and engageable by, sliding locking bolts constituting said locking portion.

5. A window security grille as defined in claim 3 wherein the frame rotatably supports a shaft having a handle for positioning inside the building and a protruding actuating end opposite the handle which aligns with, and enters for turning a corresponding shaped portion of the actuating device which is turned by turning the handle in order to effect said moving the locking portion.

6. A window security grille claimed in claim 3 wherein two security grille portions are hinged one to another, said first attachment means pivotally attaching one grille portion to one edge of the frame, and each grille portion including a respective second attachment means distal to the first attachment means.

7. A window security grille as defined in claim 3 wherein the rigid frame surround is of predetermined size so as to fit closely about a preselected window cavity.

8. A window security grille is defined in claim 1 wherein the first attachment means are constituted by hinge devices and the first edge is a low horizontal edge of the grille, when the grille is closed against the window opening, so that when the grille is opened it is effectively lowered to form an escape ladder.

9. A window security grille including:

first attachment means at a first edge of the grille, being securable to an exterior or interior wall proximate or within a window opening of a building and allowing release or pivotable movement of the grille relative to such wall;

anchor means rigidly attachable to the wall proximate the window opening to be opposite the first attachment means;

second attachment means, at a second edge of the grille opposite the first edge, including a locking portion and an actuating device both being secured to the grille and the actuating device moving the locking portion between locked and released positions, the locking portion lockingly engaging the anchor means when in the locked position when the grille is closed to secure the grille closed and releasing same when in the released position;

a release control device connected to the wall and including a handle end and an opposite actuating end inserted through the wall and protruding from the wall to engage and rotatably drive the actuating device when the grille is closed against the window opening; and wherein the grille includes a perimeter frame being hollow at least along said second edge and the actuating device and locking portion being both within the hollow portion of the perimeter frame and the anchor means is constituted by a pair of eye-bolts or like eye devices held rigid relative to the wall and being aligned with and protruding into corresponding apertures of the hollow portion of the perimeter frame when closed against the window opening, the locking portion being constituted by a pair of locking bolts, one proximate each aperture, the bolts sliding through apertures of the respective eye device so as to prevent relative retraction of the eye device from the perimeter frame when in the locked position.

* * * * *